US010092150B2

(12) United States Patent
Isley et al.

(10) Patent No.: US 10,092,150 B2
(45) Date of Patent: Oct. 9, 2018

(54) CLEANER HEAD

(71) Applicant: Dyson Technology Limited, Wiltshire (GB)

(72) Inventors: David Andrew Isley, Gloucester (GB); Damian Henri Lee, Reading (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 420 days.

(21) Appl. No.: 14/842,541

(22) Filed: Sep. 1, 2015

(65) Prior Publication Data

US 2016/0058258 A1 Mar. 3, 2016

(30) Foreign Application Priority Data

Sep. 2, 2014 (GB) ..... 1415494.2

(51) Int. Cl.
*A47L 9/04* (2006.01)
*A47L 11/19* (2006.01)

(52) U.S. Cl.
CPC ..... *A47L 9/0477* (2013.01); *A47L 9/0411* (2013.01); *A47L 9/0455* (2013.01); *A47L 11/19* (2013.01)

(58) Field of Classification Search
CPC ..... A47L 9/0477; A47L 9/0411; A47L 9/0455
See application file for complete search history.

(56) References Cited

U.S. PATENT DOCUMENTS 6,003,198 A * 12/1999 Stegens ..... A47L 9/0455 15/179
2003/0159240 A1 8/2003 Mertes et al.
2004/0019992 A1* 2/2004 Roney ..... A46B 13/001 15/179
2006/0272122 A1* 12/2006 Butler ..... A47L 9/0455 15/383

(Continued)

FOREIGN PATENT DOCUMENTS

EP 1237459 9/2002
GB 2498351 7/2013

(Continued)

OTHER PUBLICATIONS

Search Report dated Feb. 26, 2015, directed to GB Application No. 1415494.2; 1 page.

(Continued)

*Primary Examiner* — Randall Chin
(74) *Attorney, Agent, or Firm* — Morrison & Foerster LLP

(57) ABSTRACT

A cleaner head for a cleaning appliance, comprising a main body, a first bearing assembly, a second bearing assembly and a brushbar. The first bearing assembly is secured to the main body, and comprises a first stationary part fixed with respect to the main body and a first rotary part arranged to rotate with respect to the first stationary part. The second bearing assembly is secured to the main body, and comprises a second stationary part fixed with respect to the main body and a second rotary part arranged to rotate with respect to the (Continued)

second stationary part. The brushbar is coupled for rotation with the first and second rotary parts such that the brushbar rotates with the first and second rotary parts, and is configured to slidably engage the first and second rotary parts such that it can be separated from the first and second rotary parts for cleaning.

17 Claims, 4 Drawing Sheets

(56) References Cited

U.S. PATENT DOCUMENTS

2010/0306959 A1 12/2010 Follows et al.

FOREIGN PATENT DOCUMENTS

| | | |
|---|---|---|
| GB | 2499213 | 8/2013 |
| JP | 2009-45503 | 3/2009 |
| JP | 2010-284527 | 12/2010 |
| JP | 2011-50428 | 3/2011 |
| JP | 2013-146305 | 8/2013 |
| WO | WO-2013/104886 | 7/2013 |

OTHER PUBLICATIONS

Search Report dated Jan. 14, 2016 directed towards EP Application No. 15181928; 6 pages.

* cited by examiner

CLEANER HEAD

REFERENCE TO RELATED APPLICATIONS

This application claims priority to United Kingdom Application No. 1415494.2, filed Sep. 2, 2014, the entire contents of which are incorporated herein by reference.

FIELD OF THE INVENTION

This invention relates to a cleaner head for a cleaning appliance and particularly, although not exclusively, relates to a cleaner head for a vacuum cleaner, such as a vacuum cleaner for domestic use.

BACKGROUND OF THE INVENTION

Cleaner heads for vacuum cleaning appliances often comprise a rotatable brushbar for improving debris pickup from carpets.

Types of debris picked up during cleaning include dust, dirt, food particles and hair. Brushbars can become dirty during use and so need to be cleaned periodically. Cleaner heads having removable brushbars are known. Such cleaner heads enable a user to remove the brushbar in order clean the brushbar, for example by cutting away hair or threads that have become tangled around the brushbar. However, they are generally unsuitable for washing.

SUMMARY OF THE INVENTION

According to a first aspect of the present invention there is provided a cleaner head for a cleaning appliance, comprising a main body, a first bearing assembly secured to the main body, the first bearing assembly comprising a first stationary part which is fixed with respect to the main body and a first rotary part which is arranged to rotate with respect to the first stationary part, a second bearing assembly secured to the main body, the second bearing assembly comprising a second stationary part which is fixed with respect to the main body and a second rotary part which is arranged to rotate with respect to the second stationary part; and a brushbar coupled for rotation with the first and second rotary parts such that the brushbar rotates with the first and second rotary parts, wherein the brushbar is configured to slidably engage the first and second rotary parts such that the brushbar can be separated from the first and second rotary parts for cleaning.

Typically, bearing assemblies used to support vacuum cleaner brushbars comprise metallic components, such as metal races and metal rolling elements, that require lubrication to run effectively. A brushbar which can be slidably separated from the bearing assemblies can be washed, for example by immersing the brushbar in water, without risk of causing damage to the bearing assemblies.

The brushbar may slidably engage the first and second rotary parts in the longitudinal direction of the brushbar.

The brushbar may comprise respective first and second sockets at each end which are arranged to receive the respective first and second rotary parts.

Each socket may comprise an engaging feature which engages with an engaging feature provided on the corresponding rotary part in order to secure the respective sockets and rotary parts for rotation with each other.

Each engaging feature of the sockets may comprise one of a protrusion and a recess and each corresponding engaging feature of the rotary parts comprise one of the other of a protrusion and a recess, the protrusions and recesses being configured to slidably engage each other.

The brushbar may consist entirely of non-metallic materials. The first bearing assembly and/or the second bearing assembly may comprises metallic components. For example, the bearing assemblies may comprises metal bearing races and/or metal rolling elements.

The brushbar may be hollow. A brushbar motor for driving the brushbar may be housed by the brushbar. The brush bar motor may, for example, be supported by one of the bearing assemblies.

The brushbar may comprise a tufted material on an outer surface of the brushbar. The brushbar may comprise a plurality of radially extending bristles and the tufted material may be disposed between the bristles. The tufted material may extend over substantially the entire circumferential and axial extent of the regions of the brushbar between the bristles.

The first and second bearing assemblies may be disposed at opposite ends of the brushbar. The first and second bearing assemblies may be housed by the brushbar.

The main body may comprise a first part to which the first bearing assembly is secured and a second part to which the second bearing assembly is secured, the first part is detachable from the second part. The arrangement helps facilitate separation of the brushbar from the main body.

According to a second aspect of the invention there is provided a cleaning appliance comprising a cleaner head in accordance with the first aspect of the invention.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
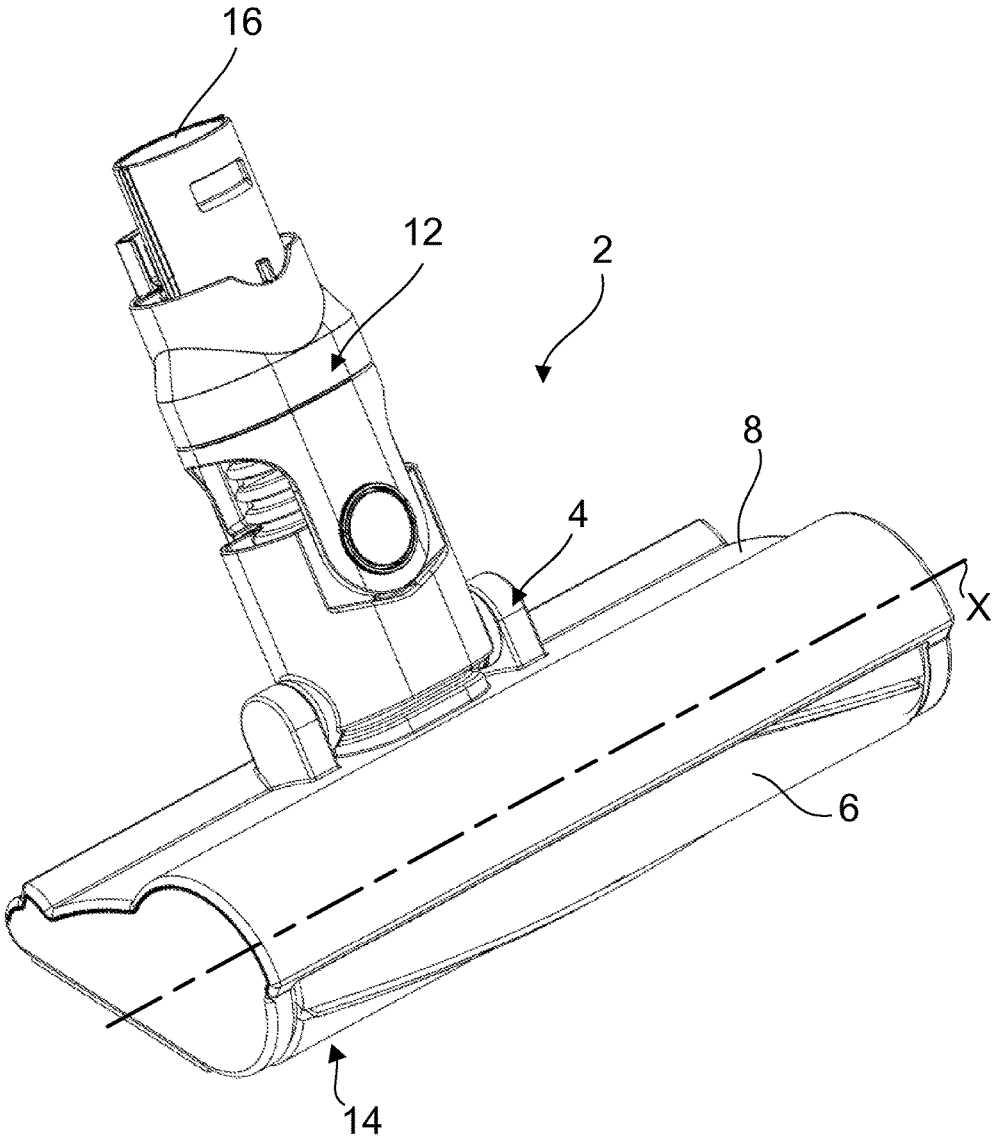
FIG. 1 is a perspective view of a cleaner head for a cleaning appliance.

FIGS. 1 to 4 show a cleaner head 2 comprising a main body 4 and an agitator in the form of a brushbar 6 supported for rotation by the main body 4. The brushbar 6 has a rotational axis X. The main body 4 comprises a housing 8 having a chamber 10 (shown in FIG. 3), within which the brushbar 6 is disposed, and an articulated neck 12 which is pivotally connected to the housing 8.

The housing 8 has an inlet opening 14 which extends across the underside and the front of the housing 8. The brushbar 6 is exposed through the opening 14. The inlet opening 14 provides an inlet to the cleaner head 2 through which air is drawn during use.

The articulated neck 12 comprises an outlet opening 16 at the end not connected to the housing 8. The outlet opening 16 provides an outlet from the cleaner head 2. The articulated neck 12 is connectable to a separator of a vacuum cleaner (not shown) either directly or via a wand or hose, for example.

Figure 2:
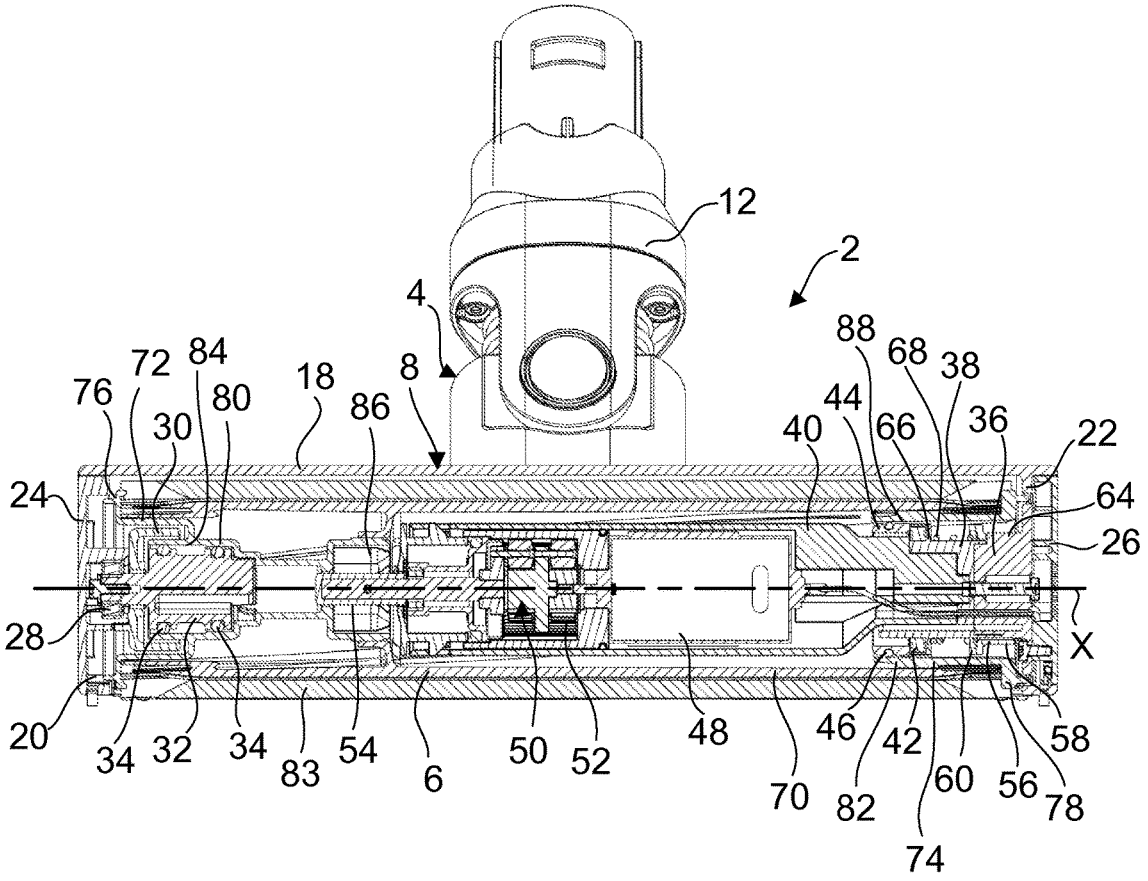
FIG. 2 is a sectional view of the cleaner head shown in FIG. 1.

FIG. 2 is a sectional view of the cleaner head 2 along the rotational axis X of the brushbar 6.

The housing 8 comprises a top portion 18 and first and second side portions 20, 22 which define the chamber 10 within which the brushbar 6 is located. Each side portion 20, 22 is provided, respectively, with first and second end caps 24, 26. The first end cap 24 is removable from the first side portion 20.

The first end cap 24, which engages with the first side portion 20, supports a first bearing 28, for example a roller bearing comprising inner and outer races interposed by rolling elements. The first bearing 28 secured to the first end cap 24 by a bearing retainer 30. The first bearing 28 supports a first brushbar mount 32 for rotation with respect to the first end cap 24. The first brushbar mount 32 projects into the chamber 10 and is provided with seals 34, in the form of o-rings, on an outer surface of the brushbar mount 32.

The second side portion 22 is covered by the second end cap 26. The second side portion 22 comprises a mounting portion 36, part of which projects into the chamber 10. A drive housing mount 38 is secured to the mounting portion 36. The drive housing mount 38 is substantially cylindrical. The drive housing mount 38 supports an elongate drive housing 40 which extends from the drive housing mount 38 further into the chamber 10 along the rotational axis X. A second bearing 42, such as a roller bearing similar to the first bearing 28, is supported by the drive housing mount 38. The second bearing 42 extends circumferentially about an outer surface of the drive housing mount 38. The second bearing 42 supports a second brushbar mount 44 for rotation with respect to the drive housing mount 38. The second brushbar mount 44 is provided with a seal 46, in the form of an o-ring, on an outer surface of the second brushbar mount 44.

The drive housing 40 houses a brushbar motor (only the casing 48 for which is shown) and a transmission 50. The transmission 50 comprises a gear arrangement 52 and a drive dog 54. The drive dog 54 protrudes from the end of the drive housing 40 opposite the drive housing mount 38.

A collector in the form of a spool 56 is mounted on the mounting portion 36 between the second bearing 42 and the second side portion 22 of the housing 8. The spool 56 is cylindrical and comprises an outer surface 58 for collecting strands of hair and a circumferential rib 60 at one end for preventing strands of hair that have collected on the outer surface 58 from sliding off the spool 56. In particular, the rib 60 helps prevent hair from getting tangled with the second bearing 42 or the brushbar motor.

The spool 56 is slidably mounted on the mounting portion 36 so that it can slide from a hair collecting position in which the spool 56 abuts the second side portion 22 and a hair removal position in which the spool 56 is spaced from the second side portion 22.

The spool 56 is provided with slots 62 (see FIG. 3) that engage with ribs 64 provided on the mounting portion 36. The ribs 64 prevent rotation of the spool 56 when the spool 56 is in the collecting position.

An abutment feature in the form of a circumferential rib 66 is provided on the drive housing mount 38. A biasing device in the form of a compression spring 68 is disposed between the rib 66 and the spool 56. One end of the spring 68 abuts the rib 66 and the other end of the spring 68 abuts the spool 56. The spring 68 biases the spool 56 into the collecting position and holds the spool 56 firmly against the second side portion 22 of the housing 8. The rib 66 provides a second function of holding the second bearing 42 in position on the drive housing mount 38.

The brushbar 6 comprises a hollow cylindrical body 70 and first and second end plugs 72, 74 disposed respectively at each of the ends of the cylindrical body 70. Each end plug 72, 74 has a flange 76, 78, which abuts a respective end of the cylindrical body 70, and a substantially cylindrical portion 80, 82 which protrudes from the flange 76, 78 into the cylindrical body 70. Bristles 83, which are arranged in circumferentially spaced strips, extend radially outwardly from the cylindrical body 70.

The end of the first plug 72 having the flange 76 is open so that the first brushbar mount 32 can be inserted into the first plug 72. The internal surface of the first plug 72 is contoured, and converges in progressive stepped portions. One of the stepped portions provides a sealing surface 84 against which the seals 34, provided on the first brushbar mount 32, seal. The first plug 72 has a socket 86 at the end of the plug 72 opposite the flange 76. The socket 86 is configured to slidably receive the drive dog 54. The first plug 72 is secured for rotation with the cylindrical body 70.

The second plug 74 is open at both ends so that the mounting portion 36, drive housing mount 38, drive housing 40, second bearing 42 and second brushbar mount 44 assembly, which forms an axle on which the brushbar 6 is supported, can pass through the open ends into the cylindrical body 70. The second plug 74 is secured for rotation with the cylindrical body 70. The second plug 74 has an internal sealing surface 88 against which the seal 46, which is provided on the second brushbar mount 44, seals.

During use, air is drawn in through the inlet opening 14, past the brushbar 6 and out through the outlet opening 16 to the separator of the vacuum cleaner to which the cleaner head 2 is connected. The brushbar motor, which in the embodiment shown is powered by a power source external to the cleaner head 2, drives the brushbar 6 in rotation via the transmission 50. In particular, the brushbar motor drives the gear arrangement 52, which drives the drive dog 54. The drive dog 54, which is received by the socket 86, drives the first plug 72 and hence the brushbar 6 to rotate within the chamber 10.

The rotating brushbar 6 agitates debris located on a surface being cleaned, for example debris located between carpet fibres. During cleaning, strands of hair (or other long fibres, such as cotton threads, ribbon etc) may be picked up by the brushbar 6. Although most strands of hair will be drawn out through the outlet opening 16 to the separator, some will wrap around the brushbar and become trapped. Furthermore, it is expected that strands of hair will work their way over the ends of the brushbar 6 through the gaps between the flanges 76, 78 and the first and second side portions 20, 22 of the housing 8. Hair strands which find their way between the gap between the flange 78 of the second plug 74 are wrapped about the outer surface 58 of the spool 56 by rotation of the brushbar 6.

The strands of hair collect as a bale around the outer surface 58 of the spool 56. The rib 60 together with the second side portion 22 prevent the hair from slipping from the spool 56. As hair accumulates, the thickness of the bail increases until it presses against a region of the inner surface of the second plug 74 which is adjacent the flange 78. The spool 56 is held rotationally fixed with respect to the mounting portion 36 by engagement of the slots 62 provided in the spool 56 with the ribs 64 on the mounting portion 36. Consequently, the region of the inner surface of the second plug 74 against which the hair presses forms a braking surface which exerts a braking torque on the brushbar 6. The braking torque exerted on the brushbar 6 increases as the quantity of hair collected by the spool 56 increases. Once the braking torque exceeds the drive torque transferred to the brushbar 6 by the brushbar motor, the brushbar 6 stalls (i.e. stops rotating). The hair then needs to be removed from the spool 56.

The first end cap 24 is removed from the end of the housing 8 together with the first bearing 28, bearing retainer 30 and first brushbar mount 32 (and seals 34). The entire assembly comprising the first bearing 28, bearing retainer 30, first brushbar mount 32 and seals 34 can, at this stage, also be removed from within the brushbar 6 thereby separating the bearing assembly from the brushbar 6. The brushbar 6 is then removed through an aperture in the first side portion 20 along the rotational axis X, thereby exposing the mounting portion 36, drive housing mount 38, drive housing 40, second bearing 42 and second brushbar mount 44. The brushbar 6 is therefore separated from both the first and second brushbar mounts 32, 44 and removed from the housing 8 completely. It will be appreciated that the first brushbar mount 32 could be separated from the brushbar 6 prior to or following removal of the brushbar 6 from the chamber 10.

The brushbar 6 is constructed entirely from non-ferrous materials. For example, the brushbar 6 may be fabricated from plastics or a combination of plastics and composite materials such as carbon fibre. Consequently, the brushbar 6 can be washed periodically without causing damage to the bearings 28, 42.

Figure 3:
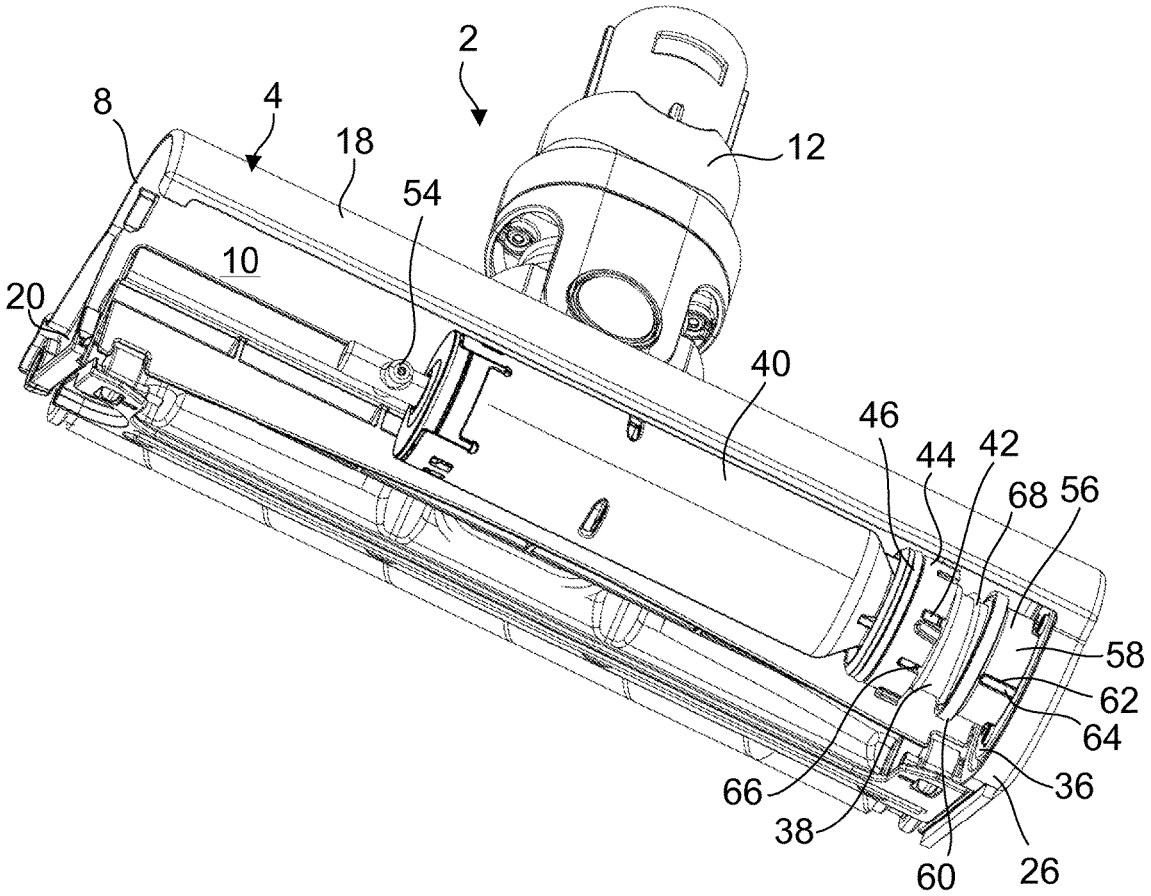
FIG. 3 is a perspective view of part of the cleaner head shown in FIG. 1 in a first configuration.

FIG. 3 shows the cleaner head 2 in a first configuration in which the brushbar 6 has been removed and the spool 56 is in the collecting position.

Figure 4:
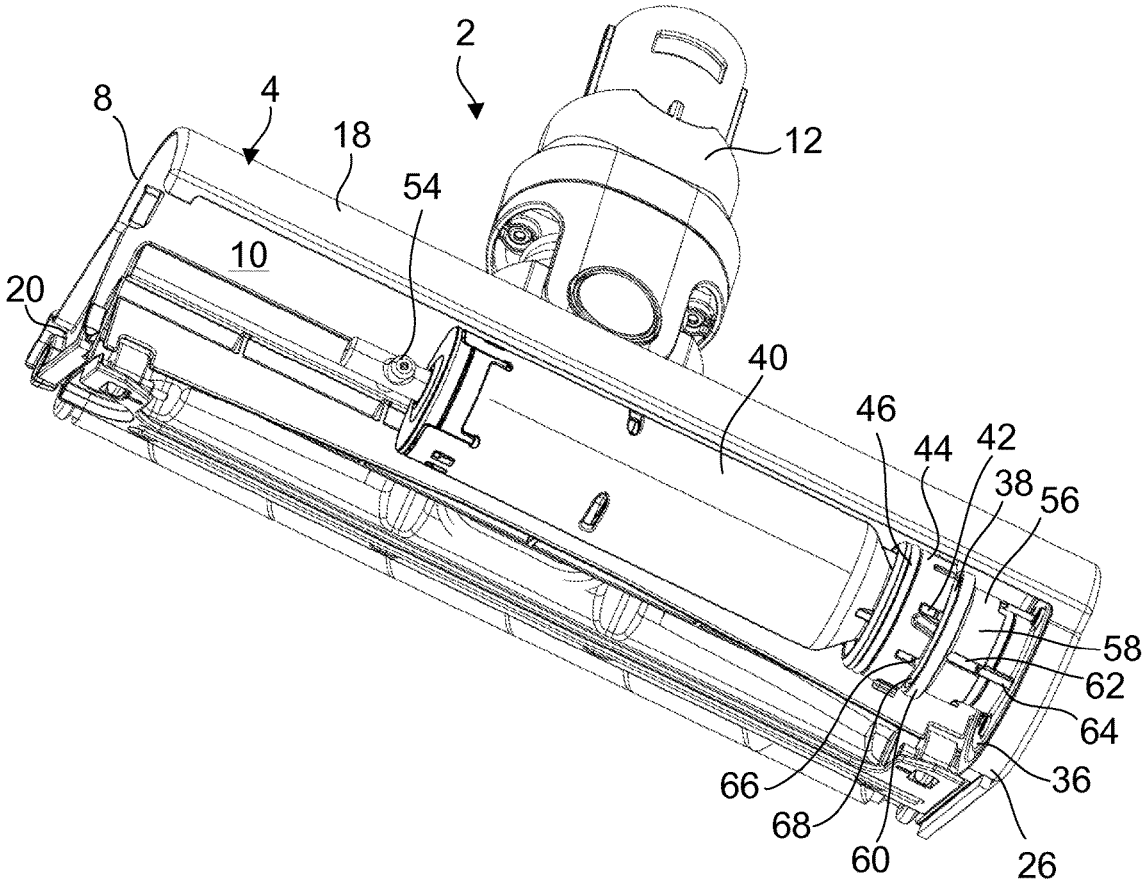
FIG. 4 is a perspective view of part of the cleaner head shown in FIG. 1 in a second configuration.

FIG. 4 corresponds to FIG. 3, but shows the cleaner head 2 in a second configuration in which the spool 56 is in the removal position (i.e. the position in which hair can be removed from the spool 56 as described above). The spool 56 is pushed into the removal position shown in FIG. 4 by sliding the spool 56 along the mounting portion 36. The stiffness of the spring 68 is such that the spool 56 can be manually moved into the removal position by a user, for example by using fingers. In the removal position, the spring 68 is compressed by the spool 56 against the circumferential rib 66 on the drive housing mount 38.

With the spool 56 in the removal position it is readily accessible to a user. In addition, a cutting element such as a pair of scissors or a knife, can be inserted into one of the slots 62 to cut the hair strands from the spool 56. This allows the hair to be cut-away from the spool 56 readily. Alternatively, the bale of hair could be slid from the outer surface 58 of the spool 56 by sliding the bale of hair from spool 56 onto the ribs 64. The hair could then be cut by inserting a cutting implement between the ribs 64. It will be appreciated that the cleaner head 2 could be modified to increase the range of movement of the spool 56 in order to increase the space between the spool 56 and the second side portion 22 in the removal position so that hair that has been slid onto the ribs 64 can be cut-away easily.

Once the hair has been removed, the spool 56 is released. The spring 68 urges the spool 56 back into the collecting position. The cleaner head 2 can then be reassembled by inserting the brushbar 6 into the chamber 10 over the drive housing 40, and the first end cap 24 replaced.

The invention claimed is:

1. A cleaner head for a cleaning appliance, comprising:

a main body comprising a housing that defines a chamber;

a first bearing assembly secured to an end cap that is removable from the housing, the first bearing assembly comprising a first stationary part which is fixed with respect to the end cap and a first rotary part which is arranged to rotate with respect to the first stationary part, wherein at least a portion of the first rotary part projects into the chamber relative to the first stationary part;

a second bearing assembly secured to the main body, the second bearing assembly comprising a second stationary part which is fixed with respect to the main body and a second rotary part which is arranged to rotate with respect to the second stationary part; and a brushbar coupled for rotation with the first and second rotary parts such that the brushbar rotates with the first and second rotary parts, wherein the brushbar is configured to slidably engage the at least a portion of the first rotary part and the second rotary part such that the brushbar can be separated from the first and second rotary parts for cleaning.

2. The cleaner head of claim 1, wherein the brushbar slidably engages the first and second rotary parts in the longitudinal direction of the brushbar.

3. The cleaner head of claim 1, wherein the brushbar comprises respective first and second sockets at each end which are arranged to receive the respective first and second rotary parts.

4. The cleaner head of claim 3, wherein each socket comprises an engaging feature which engages with an engaging feature provided on the corresponding rotary part in order to secure the respective sockets and rotary parts for rotation with each other.

5. The cleaner head of claim 4, wherein each engaging feature of the sockets comprises one of a protrusion and a recess and each corresponding engaging feature of the rotary parts comprise one of the other of a protrusion and a recess, the protrusions and recesses being configured to slidably engage each other.

6. The cleaner head of claim 1, wherein the brushbar consists entirely of non-metallic materials.

7. The cleaner head of claim 1, wherein the first and second bearing assemblies comprise metallic components.

8. The cleaner head of claim 1, wherein the brushbar is hollow and a brushbar motor for driving the brushbar is housed by the brushbar.

9. The cleaner head of claim 1, wherein the brushbar comprises a tufted material on an outer surface of the brushbar.

10. The cleaner head of claim 9, wherein the brushbar comprises a plurality of radially extending bristles and the tufted material is disposed between the bristles.

11. The cleaner head of claim 10, wherein the tufted material extends over substantially the entire circumferential and axial extent of the regions of the brushbar between the bristles.

12. The cleaner head of claim 1, wherein the first and second bearing assemblies are disposed at opposite ends of the brushbar.

13. The cleaner head of claim 1, wherein the first and second bearing assemblies are housed by the brushbar.

14. The cleaner head of claim 1, wherein the first bearing assembly comprises a bearing and the first rotary part is fixed to an inner race of the bearing.

15. The cleaner head of claim 1, wherein an inner surface of the brushbar is configured to slidably engage the first rotary part.

16. The cleaner head of claim 15, wherein the first rotary part comprises one or more resilient members for resiliently engaging the inner surface of the brushbar.

17. A cleaning appliance comprising the cleaner head of claim 1.

* * * * *